US008052490B2

(12) United States Patent
Bernasch et al.

(10) Patent No.: US 8,052,490 B2
(45) Date of Patent: Nov. 8, 2011

(54) DEVICE FOR ELECTRICALLY CONDUCTIVE CONTACTING A PIPE

(75) Inventors: Peter Bernasch, Hanover (DE); Erhard Mahlandt, Hanover (DE)

(73) Assignee: Alcatel Lucent, Paris (FR)

( * ) Notice: Subject to any disclaimer, the term of this patent is extended or adjusted under 35 U.S.C. 154(b) by 0 days.

(21) Appl. No.: 12/667,350

(22) PCT Filed: Jul. 2, 2007

(86) PCT No.: PCT/IB2007/002929

§ 371 (c)(1),
(2), (4) Date: Oct. 4, 2010

(87) PCT Pub. No.: WO2009/004400

PCT Pub. Date: Jan. 8, 2009

(65) Prior Publication Data

US 2011/0021090 A1 Jan. 27, 2011

(51) Int. Cl.
*H01R 4/28* (2006.01)

(52) U.S. Cl. ..... 439/775

(58) Field of Classification Search ..... 439/775, 439/98–100; 174/78, 88, 48, 51
See application file for complete search history.

(56) References Cited

U.S. PATENT DOCUMENTS 2,338,659 A * 1/1944 Morehouse ..... 248/74.3
2,387,295 A * 10/1945 Robertson ..... 248/74.3
2,416,063 A * 2/1947 Palmer ..... 174/40 CC
5,230,537 A * 7/1993 Newman ..... 285/112
6,297,447 B1 * 10/2001 Burnett et al. ..... 174/40 CC
6,441,303 B1 * 8/2002 Daume ..... 174/51
6,548,762 B2 * 4/2003 Jiles et al. ..... 174/78
7,414,198 B2 * 8/2008 Stansbie et al. ..... 174/74 R
2001/0011600 A1 * 8/2001 Daume ..... 174/78
2002/0112874 A1 * 8/2002 Jiles et al. ..... 174/78
2005/0048815 A1 3/2005 Daume

FOREIGN PATENT DOCUMENTS

EP 1 389 807 A1 2/2004

OTHER PUBLICATIONS

International Search Report.
Machine Translation of EP 1 389 807 A1 as obtained from the European Patent Office, Retrieved May 12, 2011, pp. 1-3.

* cited by examiner

*Primary Examiner* — Jean Duverne
(74) *Attorney, Agent, or Firm* — Fay Sharpe LLP

(57) ABSTRACT

There is provided a device for electrically conductive contacting of a pipe having a band shaped metallic clamp (2) with two end parts (6, 7), wherein the clamp is equipped with parts of a closing device (11, 13, 14) at both end parts. The device has a separator (4) made from electrically conductive material, wherein the separator is deformable under pressure and wherein the separator is attached to the inner surface of the clamp. The device further comprises insulating material (3), wherein the clamp is embedded in the insulating material leaving free the inner surface required for making contact with the pipe. Furthermore, the embedded material leaves free both end parts of the clamp enabling a direct contact between both end parts in an assembly position of the device around the pipe.

9 Claims, 3 Drawing Sheets

DEVICE FOR ELECTRICALLY CONDUCTIVE CONTACTING A PIPE

FIELD OF THE INVENTION

The invention relates to a device for electrically conductive contacting of a pipe and to an earthing kit comprising such a device.

BACKGROUND

Devices for electrically conductive contacting of a pipe are for example employed to ground the pipe. Of particular relevance is such a grounding for electrical cables that have a metallic pipe as electrical conductor. Such a pipe can for example relate to the outer conductor of a coaxial cable, e.g. a coaxial high frequency (HF)-cable.

EP 1 352 451 discloses a device for electrically conductively contacting a sectionally bared external conductor of a coaxial cable. The device has a basic body constructed as a clip which can be fixed around the cable to be contacted. The basic body is designed so as to be open in the peripheral direction and comprises at its ends bent or turned taps consisting at least partially of metal and on the faces of which facing one another in the assembled position sealing faces made of elastic material are formed. In the assembled position, the taps can be connected to one another by means of at least one screw. The device has means for limiting the screwed-in distance of the screw such that the elastic material of the sealing faces is pressed together in a defined manner when the screw is tightened. The elastic material of the sealing faces fills in the space between the taps in the assembled position. The elastic material between the taps creeps under the mechanical pressure caused by the tightened screw or screws. This leads to a reduction of the torque of the screws after a certain amount of time. The screws might then get loose and the sealing faces might get leaky.

EP 0744 788 discloses a device of which a cross sectional view is shown in FIG. 1. The device is employed for electrically conductive contacting of a pipe 1 which is bright finished on its surface. The device consists of a band shaped metallic clamp 2 which is equipped with parts of a closing device at both end parts. The end parts can be brought together in the assembly position. The clamp 2 is embedded into elastic insulating material 3 which leaves free the inner surface of the clamp which is required for making contact with the pipe 1. The clamp 2 has captively attached to it on its inner surface a separator 4 made from electrically very conductive material which can be deformed under pressure and which extends substantially over the part of the inner surface of the clamp that is in the assembly position surroundings the pipe 1. For grounding the clamp 2 and thus for grounding the pipe 1 in an assembly position of the clamp 2, a band of copper 5 is foreseen to be attached to the clamp 2. The band of copper 5 is used as a line to ground.

FIG. 2 shows a further cross sectional view of the device disclosed by EP 0 744 788. The clamp 2 comprises as mentioned above two end parts that are adapted to face each other in the assembly position and that comprise parts of a closing device that are not shown in FIG. 2. An end part 6 of the clamp 2 is shown. The end part 6 can be regarded as a tap that is bent or turned with respect to the clamp part that is fixed around the cable or pipe to be contacted. The parts of the closing device can relate to, e.g., tapped holes in the end parts, wherein in the non-assembly position a screw is screwed into one tapped hole and the facing hole is foreseen to receive the screw when it is screwed into the tapped holes. The inner side of the end part 6 which faces the other end part of the clamp 2 is completely covered by the elastic insulating material 3. When the above mentioned screw is tightened, the end parts are brought together such that the clamp is tightly fixed around the pipe and such that the elastic insulating material 3 in between the end parts is pressed together for making a seal in between the end parts. A disadvantage is however, that there is an undefined force applied to the insulating material 3, when the screws are tightened, as the insulating material is typically elastic. For example, the force applied to the sealing material varies much depending on the installer as there is no defined end stop. Applying not enough torque to the screws may lead to an unsealed connection between the device 2 and the pipe 1. Applying too much torque may damage the insulating material 3 or the tapped holes. Even if the appropriate force is applied to the end parts, the torque on a screw reduces after some time as the insulating material 3 between the end parts creeps under the mechanical pressure and is further subject to deterioration due to aging of the elastic insulating material. The screw may then become completely loose if there is an additional vibration by wind load which is typical for installations made to outdoor coaxial cables.

SUMMARY OF THE INVENTION

It is an object of the invention to provide an improved device for electrically conductive contacting of a pipe which does not have the disadvantages described above.

According to a first aspect of the invention, there is provided a device for electrically conductive contacting of a pipe. In accordance with an embodiment of the invention, the device comprises a band shaped metallic clamp having two end parts, wherein the clamp is equipped with parts of a closing device at both end parts. The device has a separator made from electrically conductive material, wherein the separator is deformable under pressure and attached to the inner surface of the clamp. The device comprises elastic insulating material, wherein the clamp is embedded in the elastic and insulating material leaving free the inner surface required for making the contact with the pipe. Further, the elastic insulating material leaves free both end parts of the clamp enabling a direct contact between both end parts in an assembly position of the device around the pipe.

The end parts of the clamp consist of a metallic material and are therefore in essence not compressible. As in the assembly position, the end parts are in direct contact with respect to each other, the parts of the closing device that are used to clamp the end parts together can be tightened with a fixed and defined force. As there is no insulating material in between the two end parts at least in the vicinity of the parts of the closing device, the elastic insulating material which is subject to creep and deterioration due to aging effects does not have any effect on the fixed and defined force used to clamp the end parts together by use the closing device.

As already mentioned in the background section of this document, appropriate parts of a closing device may relate to one or more tapped holes made into the end parts such that a hole in one end part stands vis-à-vis with respect to a hole in the other end part. Further, a screw might be inserted into a tapped hole of one end part and the device is assembled by screwing in the screw into the vis-à-vis hole of the other end part. As, at least in the vicinity of the holes, no insulating material is placed in between the counter facing end parts, the screw can be tightened up to a fixed and defined torque. Further, the elastic insulating material which is subject to creep will have no effect on the torque exerted on the screw. The screw remains fixed and as a consequence the device will electrically conductive contact the pipe and provide good insulation for the pipe from the surroundings even if the insulating material is subject to creep.

The device is furthermore particularly advantageous, as, for example with respect to the device disclosed in EP 0 744 788, no additional manufacturing step is required for the production of the device in accordance with the invention. Furthermore, no additional piece-parts have to be produced and inserted into an earthing kit comprising such a device. Thus, the device provides a cost effective and simple solution that does not have the disadvantages described in the background section.

In accordance with an embodiment of the invention, the space between both end parts relates to a first region and a second region. The first region relates to a space bordered in the assembly position by the pipe. The first region is furthermore bordered by a fraction of the inner surface of each end part and insulating material is attached to at least one of the inner surfaces of the end parts bordering the first region. The second region is equipped with the parts of the closing device, and the inner surfaces of the end parts bordering the second region are adapted to be in contact in the assembly position.

The usage of insulating material in between the two end parts ensures that the pipe is completely sealed with respect to the exterior.

In accordance with an embodiment of the invention, at least one of the end parts comprises a shoulder.

In accordance with an embodiment of the invention, the first region is bordered by the shoulder or by the shoulders in case both end parts comprise a shoulder. The usage of a shoulder provides the advantage that sufficient space for the elastic insulating material is provided in between the end parts of the clamp.

In accordance with an embodiment of the invention, at least one of the end parts comprises in the vicinity of the parts of the closing device a reinforcing extension. The reinforcing extension contributes to an enforcement of the stability and rigidity of the end part at least in the vicinity of the parts of the closing device and therefore allows for an application of a higher force or torque on the parts of the closing devices for fixing the device in the assembly position.

In accordance with an embodiment of the invention, the reinforcing extension relates to at least one plate of a substantially uncompressible material. In particular, the at least one plate is made of a metal. The metal might be copper or stainless steel.

In accordance with an embodiment of the invention, at least one of the end parts comprises at least two layers of the band shaped metallic clamp. This leads to an increase of the stability and rigidness of the end parts.

In accordance with an embodiment of the invention, the pipe relates to a coaxial cable, in particular a HF-coaxial cable.

In accordance with an embodiment of the invention, the separator is a band made from copper braid and spot connected to the clamp.

In accordance with an embodiment of the invention, the clamp, including the insulating material and the separator, are formed into an arc shape.

In accordance with an embodiment of the invention, the insulating material has sealing lips which protrude along the whole of the length along both long opposing edges of the clamp.

In accordance with an embodiment of the invention, recesses are made in the sealing lips for holding additional sealing material.

In accordance with an embodiment of the invention, the wall thickness of the insulating material is larger in the closing area of the clamp at the furthest inner position than the furthest outer position.

In accordance with an embodiment of the invention, at least one of the two end parts comprises a first recess in the inner surface which faces the other end part. The first recess comprises elastic and insulating material.

In accordance with an embodiment of the invention, the inner surface of the clamp comprises a second recess and a third recess. The second and third recesses comprise elastic insulating material. The inner surface of the clamp faces the pipe when the clamp is mounted around the pipe.

In accordance with an embodiment of the invention, the clamp is made out of copper.

In accordance with an embodiment of the invention, the clamp is made out of stainless steel.

In accordance with an embodiment of the invention, the insulating material consists of rubber.

According to a second aspect of the invention, there is provided an earthing kit comprising a device in accordance with the invention and an electrical conductor such as for example a cable or a copper band. The conductor is used for making an electrical contact between the device and the ground.

BRIEF DESCRIPTION OF THE DRAWINGS

In the following, embodiments of the invention will be described in greater detail by way of example only making reference to the drawings in which.

DETAILED DESCRIPTION

Figure 1:
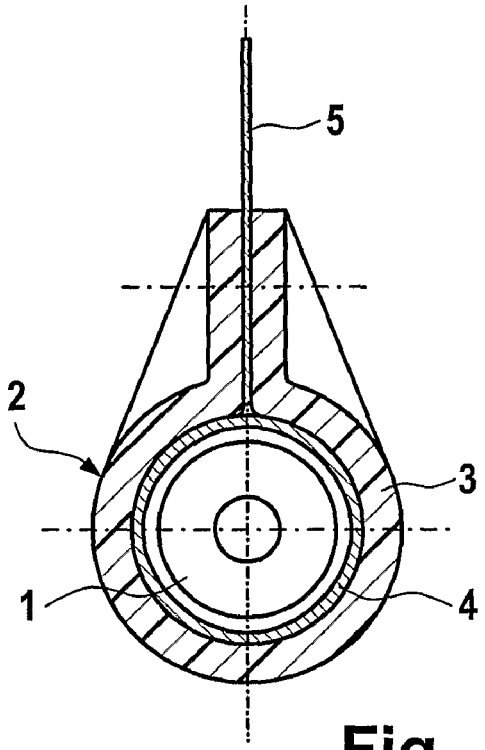
Fig. 1 (PRIOR ART)
FIG. 1 shows a cross sectional view of a device according to prior art.
Figure 2:
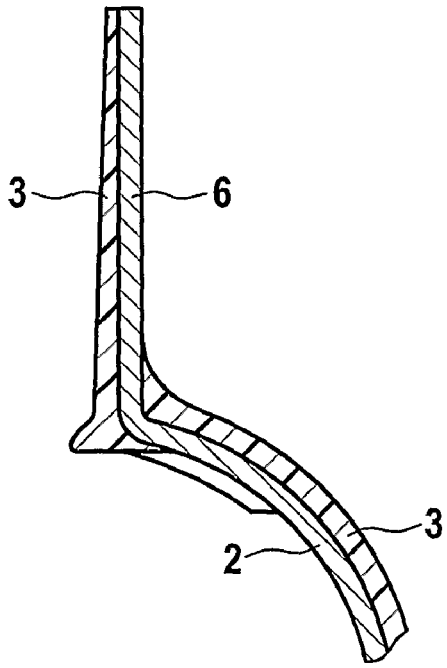
Fig. 2 (PRIOR ART)
FIG. 2 shows a fraction of a device according to prior art.

Reference numerals of analogous elements are identical in the FIGS. 1-10.

Figure 3:
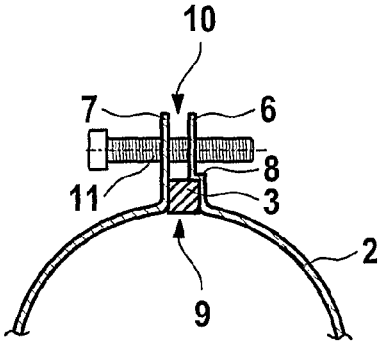
FIG. 3 shows a cross sectional view of a portion of a device in accordance with the invention.

FIG. 3 shows a cross sectional view of a portion of a device in accordance with the invention. The device comprises a clamp 2 of which only a part is shown. The clamp 2 consists of a metallic material, e.g., copper or stainless steel, and is band shaped. The clamp 2 has end parts 6 and 7. The end part 6 comprises a shoulder 8. Elastic insulating material 3 is placed in between the end parts 6 and 7. The space between the end parts 6 and 7 can therefore be divided into a first region 9 and a second region 10. The first region 9 is bordered in the assembly position by the pipe which is not shown in FIG. 3 and by a fraction of the inner surface of each end part as indicated by the scratched region in FIG. 3 that relates also to the insulating material 3. The first region is bordered in particular by the shoulder 8.

The second region 10 is bordered by the remaining inner surfaces of the end parts 6 and 7. Further, the clamp 2 is equipped with parts of the closing device in the second region 10. As shown in FIG. 3, the parts of the closing device consist of a screw 11 that is mounted in tapped holes in the end parts 6 and 7 such that the screw 11 passes through the second region. By tightening the screw 11, the inner surfaces of the end parts 6 and 7 can be brought in direct contact with each other. In particular, the clamp 2 is adapted and designed in a way, that the end parts are in direct contact at least in the second region 10 when the clamp is assembled around the pipe.

Figure 4:
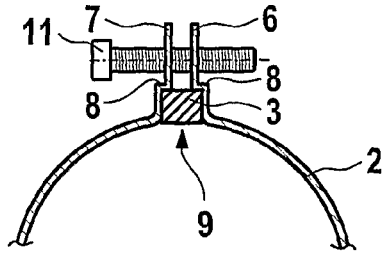
FIG. 4 shows a cross sectional view of a portion of a device in accordance with the invention.

FIG. 4 shows a cross sectional view of another device in accordance with the invention. According to the embodiment of the device shown here, the end part 6 of the clamp 2 has a shoulder 8 and the end part 7 of the clamp 2 has a shoulder 8. Due to the two shoulders, the first region 9 is larger with respect to the embodiment shown in FIG. 3. Thus, more insulating material 3 can be placed in between the two end parts which ensures a proper insulation of the pipe with respect to the exterior.

Figure 5:
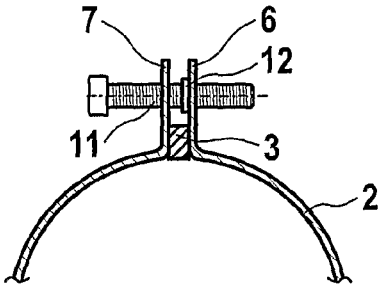
FIG. 5 shows a cross sectional view of a portion device in accordance with the invention.

FIG. 5 shows another embodiment of the device in accordance with the invention. The end part 6 of the clamp 2 comprises in the vicinity of the tapped hole for the screw 11 a reinforcing extension 12 which can be made for example of a metallic plate that is attached to the end part 6. The reinforcing extension 12 causes the end part 6 in the vicinity of the hole to be more rigid and therefore allows for a tightening of the screw by use of a relative high torque. When the screw 11 is tightened, the inner surface of the reinforcing extension 12 that is opposite to the inner surface of the end part 7 is in direct contact with this inner surface of the end part 7.

Figure 6:
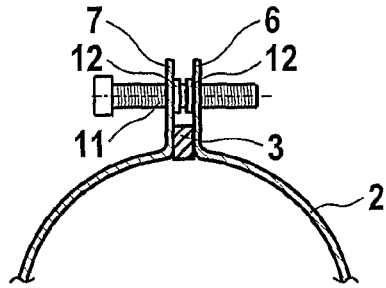
FIG. 6 shows a cross sectional view of a portion of a device in accordance with the invention.

FIG. 6 shows an embodiment of the device in accordance with the invention, wherein the end part 6 and the end part 7 of the clamp 2 comprise a reinforcing extension 12.

Figure 7:
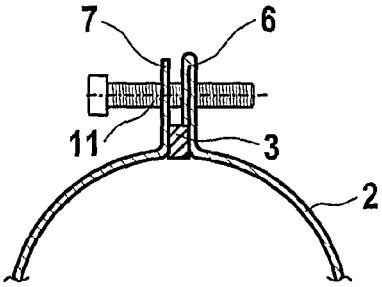
FIG. 7 shows a cross sectional view of a portion of a device in accordance with the invention.

FIG. 7 shows a cross sectional view of a device in accordance with the invention, wherein the end part 6 comprises at least two layers of the band shaped metallic clamp. The end part 6 is for example made by folding the end part 6 at the end in order to arrange at least two layers in a way that they contribute to a reinforcement of the end part 6.

Figure 8:
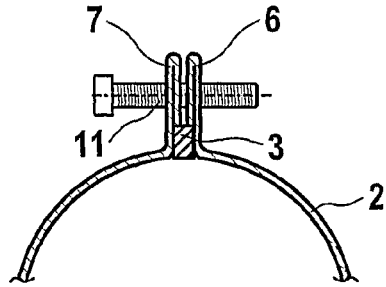
FIG. 8 shows a cross sectional view of a part of a device in accordance with the invention.

FIG. 8 shows a cross sectional view of parts of a device in accordance with the invention. As can be seen, both end parts 6 and 7 of clamp 2 comprise at least two layers of the clamp 2. The end parts 6, 7 are for example fabricated by folding the end parts of the clamp 2 in direction towards the centre of the clamp 2.

Figure 9:
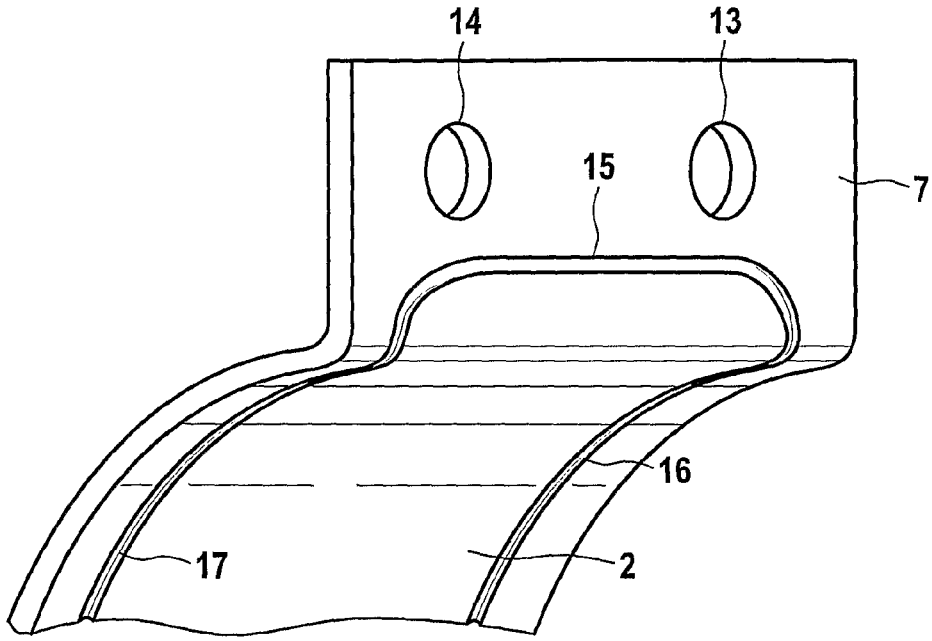
FIG. 9 shows schematically an end part of a clamp of a device in accordance with the invention.

FIG. 9 shows a view of the end part 7 of the clamp 2. As can be seen, the end part 7 comprises two holes 13 and 14. The end part 6 which is not shown in FIG. 9 also comprises two holes, wherein one hole faces hole 13 and wherein the other hole faces hole 15 such that screws can be mounted in the holes in order to tighten the clamp 2. The end part 7 further comprises a first recess 15 which comprises elastic insulating material. In contrast to the embodiment described for example in FIG. 3, the insulating material does not completely fill the first region between the end parts but is only comprised in the first recess. The clamp 2 also comprises a second recess 16 and a third recess 17 that comprise elastic insulating material. The recesses 16 and 17 are comprised in the inner surface of the clamp 2 and face the pipe in the mounting position. The insulating material in the recesses 16 and 17 as well as in the recess 15 therefore provides good insulation of the pipe with respect to the surroundings.

Figure 10:
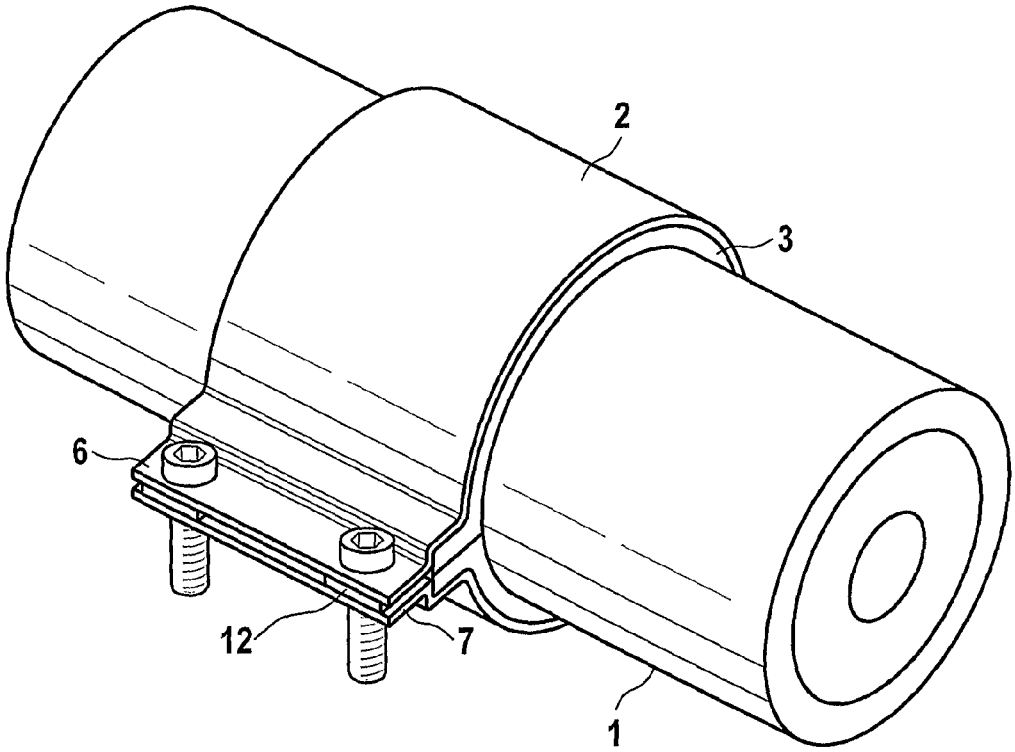
FIG. 10 shows a device in accordance with the invention assembled around a pipe.

FIG. 10 shows schematically a pipe 1 around which a device in accordance with the invention is assembled. In particular, the clamp 2 of the device is shown, wherein the clamp 2 is embedded in elastic insulating material 3 and wherein in between the end parts 6 and 7 of the clamp, a reinforcing extension 12, which might be for example part of the end part 6 is comprised.

| List of Reference Numerals | |
|---|---|
| 1 | Pipe |
| 2 | Clamp |
| 3 | Elastic insulating material |
| 4 | Separator |
| 5 | Band of copper |
| 6 | End part |
| 7 | End part |
| 8 | Shoulder |
| 9 | First region |
| 10 | Second region |
| 11 | Screw |
| 12 | Reinforcing extension |
| 13 | Hole |
| 14 | Hole |
| 15 | First recess |
| 16 | Second recess |
| 17 | Third recess |

The invention claimed is:

1. Device for electrically conductive contacting of a pipe (1) comprising:

a band shaped metallic clamp (2) having two end parts (6, 7), wherein the clamp is equipped with parts of a closing device (11, 13, 14) at both end parts;

a separator (4) made from electrically conductive material, wherein the separator is deformable under pressure, wherein the separator is attached to the inner surface of the clamp;

elastic insulating material (3), wherein the clamp is embedded in the elastic insulating material leaving free the inner surface required for making contact with the pipe;

characterized in that the embedded material leaves free both end parts of the clamp enabling a direct contact between both end parts in an assembly position of the device around the pipe; and wherein the space between both end parts (6, 7) relates to a first region (9) and a second region (10), wherein the first region relates to a space bordered in the assembly position by the pipe, wherein the first region is furthermore bordered by a fraction of the inner surface of each end part, wherein insulating material (3) is attached to at least one of the inner surfaces of the end parts bordering the first region, wherein the second region is equipped with the parts of the closing device, and wherein the inner surfaces of the end parts bordering the second region are adapted to be in contact in the assembly position.

2. Device according to claim 1, wherein at least one of the end parts comprises a shoulder (8).

3. Device according to claim 2, wherein the first region (9) is bordered by the shoulder.

4. Device according to claim 1, wherein at least one of the end parts (6,7) comprises in the vicinity of the parts of the closing device a reinforcing extension (12).

5. Device according to claim 4, wherein the reinforcing extension relates to at least one plate of a substantially uncompressible material.

6. Device according to claim 1, wherein at least one of the end parts comprises at least two layers of the band shaped metallic clamp (2).

7. Device according to claim 1, wherein the inner surface of at least one of the two end parts (7) comprises a first recess (15), wherein the first recess comprises elastic insulating material, wherein the inner surface faces the other end part of the clamp (2).

8. Device according to claim 7, wherein the inner surface of the clamp (2) comprises a second recess (16) and a third recess (17), wherein the second and third recesses comprise elastic insulating material.

9. Device according to claim 1 implemented in an earthing kit comprising an electrical conductor (5) for making an electrical contact between the device and the ground.

* * * * *